United States Patent [19]

Pasquan

[11] 4,030,422

[45] June 21, 1977

[54] SWITCHING SYSTEM FOR GUIDED VEHICLES

[76] Inventor: Raymond F. Pasquan, 232 First Ave., Toronto, Ontario, Canada

[22] Filed: Dec. 8, 1975

[21] Appl. No.: 638,326

[52] U.S. Cl. ..... 104/131

[51] Int. Cl.[2] ..... E01B 25/06

[58] Field of Search ..... 104/131, 130, 121

[56] References Cited

UNITED STATES PATENTS

| | | | |
|---|---|---|---|
| 3,225,704 | 12/1965 | Gilvar et al. | 104/130 |
| 3,590,743 | 7/1971 | Larson | 104/130 |
| 3,906,863 | 9/1975 | Baldelli | 104/131 |

FOREIGN PATENTS OR APPLICATIONS

| | | | |
|---|---|---|---|
| 1,248,475 | 10/1971 | United Kingdom | 104/131 |

*Primary Examiner*—Robert J. Spar
*Assistant Examiner*—James M. Slattery
*Attorney, Agent, or Firm*—James A. Lamb

[57] ABSTRACT

A system for the switching of guided vehicles vertically has a main guideway and a secondary guideway each having a pair of spaced guides. The guides of the main and secondary guideways branch at a switching region and diverge vertically. Each guide in the main guideway has a vertically disposed inwardly facing running surface extending upwardly from and outwardly of a horizontally disposed running surface. Each guide in the secondary guideway has a vertically disposed inwardly facing running surface, coextensive in the switching region with the vertical surfaces in the main guideway, extending downwardly from and inwardly of a horizontal running surface. The guided vehicle has a main support arrangement for coacting with or running on the horizontal surfaces of the main guides for supporting the vehicle and a guide apparatus for coacting with or running on the vertically disposed surfaces for providing lateral guidance. Also the guided vehicle has a retractable support arrangement for coacting with or running on the horizontal surfaces of the secondary guides when extended to support the vehicle from the secondary guides. When the retractable support arrangement is extended prior to a switching region the retractable support arrangement will coact with the horizontal surfaces of the secondary guides and conduct the vehicle away from the main guides. When the retractable support arrangement is not extended the vehicle will move along the main guideway through a switching region. The lateral guide apparatus is always able to coact with vertically disposed surfaces whether the vehicle is on the main or secondary guideway to provide at all times lateral guidance and braking or driving force as required.

6 Claims, 7 Drawing Figures

SWITCHING SYSTEM FOR GUIDED VEHICLES

Figures 1, 2, 3, 4, 5, 6, 7:
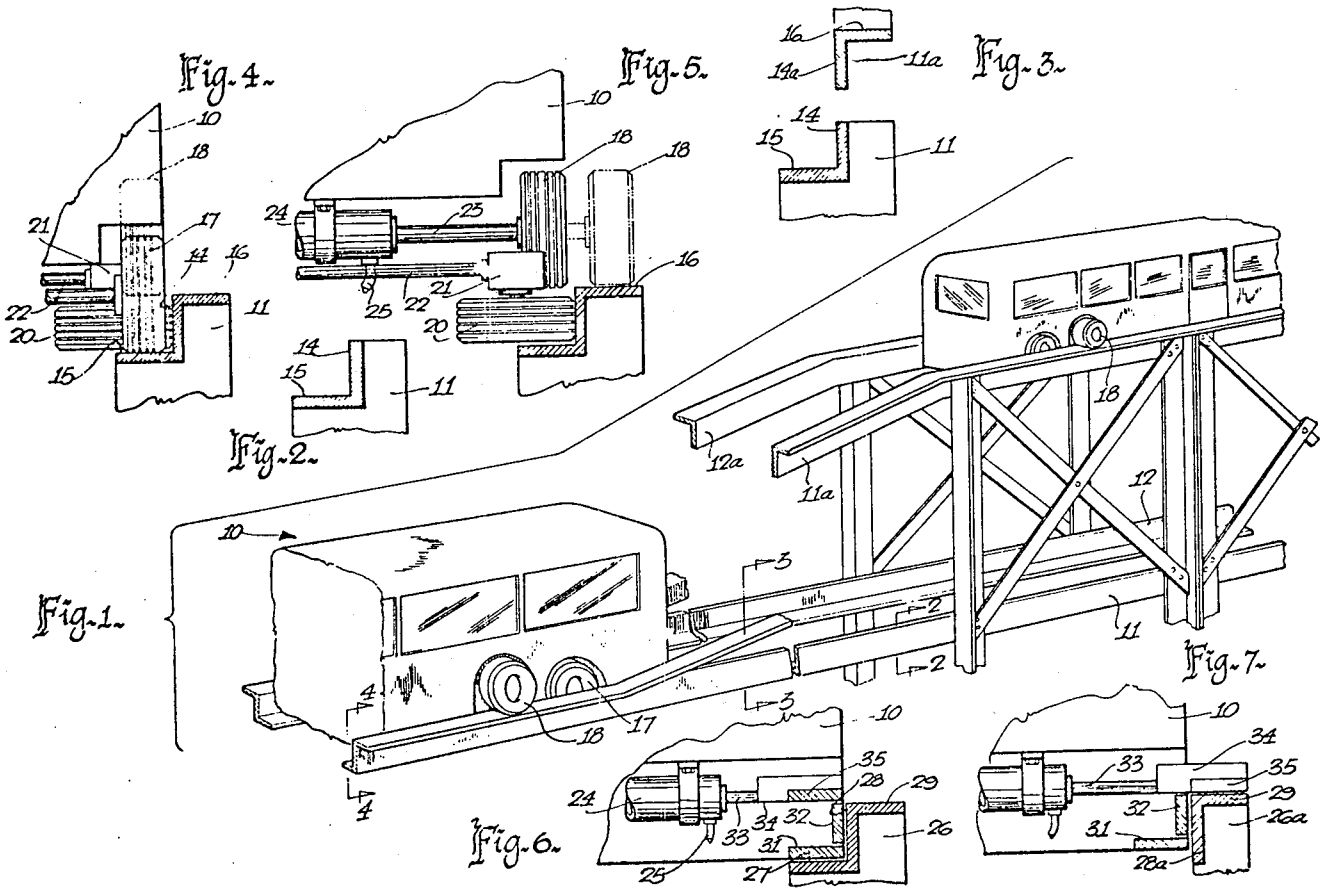

This invention relates to a switching system for guided vehicles, and in particular it relates to a switching system controlled from the vehicle or "on vehicle" system.

In the switching of guided or tracked vehicles, vertical switching arrangements have many advantages. For example, vertical switching of vehicles carrying passengers tends to minimize the lateral forces on the passengers; vertical construction of a switching arrangement may be simpler in that less structure is required and the switching region may be simpler to enclose and vertical switching arrangements conserve area (that is, the placing of a secondary guideway over or beneath a main guideway reduces the ground area necessary for the placement of the guideways) which may be a very significant factor if land costs are high. However, in spite of the advantages of vertical switching systems, they have not been widely used. This is, perhaps, because of the complexity of the switching arrangements or because of the gaps at the switch in the guideway that provides the cooperating member for the vehicle drive system or because of the necessity to change drives at prior art switches.

A system for vertical switching of a guided air cushion vehicle is known where the vehicle is guided by a lower guide rail along the main track. The vehicle has an auxiliary overhead structure which may be extended to engage an overhead guide member for switching. The overhead guide member slopes upwardly and away from the lower guide rail. When the auxiliary structure engages the overhead guide member the vehicle moves along the overhead guide member and is raised from the lower guide rail. Thus the vehicle is switched vertically and may be returned to the same lower guide rail or to another one by a downward slope to the overhead guide member. This switching system relies on the momentum of the vehicle to carry it up the slope of the overhead guide member or it changes from one drive system cooperating with the lower guide rail to another drive system cooperating with the overhead guide member.

The present invention provides a switching system which has no gaps in the guideways at the switching region, where the same drive means is used on the main and secondary guides and the driving and braking may be continuous during the switching, and where the switching may be controlled on the vehicle.

It is therefore a feature of the invention to provide a new and simplified switching system for guided vehicles.

It is another feature of the invention to provide a vertical type switching system in which the guideway is continuous whether the vehicle is on the main track, the secondary track, or switching from one to the other.

It is yet another feature of the invention to provide a novel vertical switching system for guided vehicles where the switching is controlled on the vehicle, and where the drive and braking may be continuous during switching.

According to the invention there is provided a switching system for guided vehicles, comprising a main guideway having a pair of horizontally spaced main guides, each main guide having a vertically disposed running surface and a horizontally disposed running surface, the vertically disposed surfaces on said main guides facing one another and extending upwardly from and outwardly of respective ones of said horizontally disposed running surfaces, a secondary guideway having a pair of horizontally spaced secondary guides, each secondary guide having a vertically disposed running surface and a horizontally disposed running surface, the vertically disposed surfaces of said secondary guides facing one another and being spaced apart the same distance as said vertically disposed surfaces of said main guide, the horizontally disposed running surfaces of said secondary guides being located outwardly of said vertically disposed running surfaces of said secondary guides, said secondary guides joining said main guides at a switching region, said vertically disposed surfaces of said secondary guides being coextensive with respective ones of said vertically disposed surfaces of said main guides in said switching region, said secondary guideway diverging vertically from said main guideway with said horizontally disposed surfaces of said secondary guides being at a level which is above said horizontally disposed surfaces of said main guides, a vehicle having main support means for coacting with said horizontally disposed surfaces of said main guides for supporting said vehicle on said main guides, guide means for coacting with said vertically disposed surfaces on each side of said vehicle for providing lateral guidance, and retractable support means on both sides of said vehicle having a retracted and an extended position, said retractable support means in its retracted position being clear of all guides and adapted to be moved to its extended position prior to said vehicle reaching said switching region with said support means being above and clear of said horizontally disposed surfaces of said secondary guides whereby when said vehicle reaches said switching region said retractable support means coacts with the horizontally disposed surfaces of said secondary guides to support said vehicle thereon, the coaction between said guide means for coacting with said vertically disposed surfaces and said vertically disposed surfaces being continuous.

The invention will be better understood from the following more detailed description and with reference to the accompanying drawings, in which FIG. 1 is a schematic isometric view of portions of vehicles on a guideway in a vertical switching arrangement according to the invention, FIGS. 2 and 3 are sectional views of suitable guideways at areas indicated as 2 — 2 and 3 — 3 in FIG. 1, FIG. 4 is an elevation showing a main support wheel and a guide wheel, FIG. 5 is an elevation showing a switching wheel and a guide wheel, FIGS. 6 and 7 are elevations showing retracted and extended positions of a switching element in a switching system using eddy current levitation and eddy current guide means.

Referring to FIG. 1 there is shown part of a guideway system at a switching region in a guided vehicle transportation system. The term "switching region" is intended to mean the region where a main guide or guideway and a secondary guide or guideway branch or join. The switching region may also be referred to as a transition region. In FIG. 1 a portion of a vehicle 10 is shown on a main guideway having two guides or guide rails 11 and 12 as shown. The guide rails have different cross-sections at different parts in the guideway system. For example, the guide 11 is shown in section in FIG. 2 at location 2 — 2 of FIG. 1. This is the general form of a section of a guide suitable for the main guideway in between switching regions. It has a vertical running or bearing surface 14 and a horizontal running or bearing surface 15. The guide 11 is shown in section in FIG. 3 at location 3 — 3 in FIG. 1. At location 3 — 3 the guide 11 has just branched. The main portion 11 continues in a generally horizontal direction while a secondary guide 11*a* slopes upwardly from left to right in FIG. 1. That is, the main guide continues with its running surfaces 14 and 15 as before and the secondary guide 11*a* slopes upwardly and has a vertical running surface 14*a* and a horizontal running surface 16. The running surfaces 14 and 14*a* are co-planar in the transition area where they branch or join and they provide a continuous surface. That is, the vertical surfaces are co-extensive at the transition. The guide 11 is shown in section in FIG. 4 at location 4 — 4 in FIG. 1. At location 4 — 4 the guide 11 has the same running surfaces 14 and 15 as at location 2 — 2 but the second horizontal running surface 16 is present.

Thus, it will be seen that a vehicle moving from left to right in FIG. 1 would be on a main guide of a section shown in FIG. 2, then FIG. 4 and then FIG. 3.

The guides 11 and 11*a* are, of course, only one side of the guideway system and corresponding guides 12 and 12*a* are on the other side of the guideway.

The secondary guideway has been described as sloping upwardly from the main guideway at the switching or transition region. It will, however, be apparent that the secondary guideway could continue in a substantially horizontal plane while the main guideway sloped downwardly, or alternately that the secondary guideway had a generally upwardly slope and the main guideway a generally downwardly slope. The secondary guideway diverges vertically from the main guideway and it does not matter whether the main guideway slopes downwardly or the secondary guideway slopes upwardly. It will also be apparent that "main" and "secondary" are for convenience of description and are not intended to relate to the importance of one guideway to another in any particular system.

As can be seen in FIG. 1 there are two sets of support wheels. The main support wheels are indicated at 17 and the auxiliary or retractable support wheels are indicated at 18.

Referring to FIG. 4, a main support wheel 17 is shown in engagement with horizontal running surface 15. A guide wheel 20 is disposed horizontally and is shown in engagement with vertical running surface 14. The retractable support wheel 18 is indicated by a broken line in its retracted position.

Referring to FIG. 5, the guide wheel 20 is again shown in engagement with vertical running surface 14. Both the vehicle drive and the braking are preferably by means of guide wheels 20 as these wheels are always in continuous engagement with vertically disposed running surfaces. Therefore, guide wheel 20 is shown supported from a gear box 21 powered by a driving axle 22. The wheel 20 may, of course, be driven directly by a motor at 21.

The retractable support wheel 18 is mounted on an axle 23 which extends into a cylinder 24. Cylinder 24 is provided with hydraulic fluid under pressure via connection 25 to move the wheel 18 between its retracted position as shown in solid lines and its extended position as shown in broken lines. When the wheel 18 is in its extended position and the vehicle is on the guide just prior to the transition or branching of the secondary guides, the wheel 18 is just above the surface 16 so that there is no engagement between the wheel and surface 16. That is, the wheel 18 is free to retract and extend.

The operation of the switching system will be apparent. As the vehicle moves along the main guideway the main wheels 17 engage surface 15 of guides 11 and 12, and the guide wheels 20 engage surface 14 of guides 11 and 12. If the retractable support wheels 18 remain retracted, the vehicle will continue to run on the main guides and will move between secondary guides 11*a* and 12*a* at any switching region. The guide wheels 20 are always in engagement with surfaces 14 and there are no interruptions in this engagement.

If the retractable support wheels 18 are extended prior to the vehicle reaching a switching region, they will be positioned above and just clear of surface 16. As the secondary guide rails 11*a* and 12*a* slope upwardly from guides 11 and 12, the wheels 18 will engage surface 16 and the weight of the vehicle will be taken by wheels 18. The main support wheels 17 will then be lifted away from engagement with surface 15 as the vehicle moves upwardly along sloping guide rails 11*a* and 12*a*. The guide wheels 20 move from engagement with surface 14 to surface 14*a* without interruption as the surfaces are coextensive where they meet. There is no gap in engagement of the guide wheels, and as these wheels 20 provide the drive and braking in the preferred embodiment, there are no interruptions in the driving or braking. FIG. 1 shows in the upper part thereof vehicle 10 on the secondary guide 11*a* and 12*a* supported by retractable wheels 18.

It is desirable to have a safety interlock on the retractable support wheels 18 which ensures the wheels are all retracted or all extended.

Referring now to FIGS. 6 and 7 there is shown an embodiment of the invention in a vehicle transportation system using eddy current levitation. In FIG. 6 there is a guide 26 with sheets of a metal such as aluminum on the surface. That is there is a first horizontal portion of a sheet of metal 27, a vertical portion 28 and a second horizontal portion 29. These portions may be separate and they compare generally to running surfaces 15, 14 and 16 of FIG. 4. As is well known, the metal sheets or strips 27, 28 and 29 are not necessarily on the surface of the guide. They may be covered or embedded in some designs. However, for convenience, these sheets will be referred to as "running surfaces". The vehicle in FIG. 6 has magnetic field forming devices shown schematically as 31 and 32, such as superconducting coils, which coact with metal sheets 27 and 28, respectively, to provide support and guidance to the vehicle on the main guideway. A cylinder 24 (as before) has an extensible shaft 33 which carries a retractable support device 34 including a magnetic field forming device 35. The retractable device 34 is shown in its retracted position in FIG. 6 and in its extended position in FIG. 7.

In FIG. 7 the extended support device 34 is supporting the vehicle because of coaction between the field forming device 35 and the metal plate 29. The secondary guide 26*a* has separated or branched from guide 26 and is providing the support. The lateral guidance is provided by coaction between metal plate 28 and magnetic field forming device 32 on the main guideway and between metal plate 28*a* and magnetic field forming device 32 on the secondary guideway. There is no interruption in this lateral guidance.

It is believed that further description of the embodiment of FIGS. 6 and 7 is not necessary for an understanding of the operation of this embodiment.

It will be apparent that other main support means could be used for coacting with the horizontally disposed surfaces of the main guides, other retractable support means could be used for coacting with the horizontally disposed surfaces of the secondary guides, and other guide means could be used for coacting with the vertically disposed surfaces of the main or secondary guides depending on which the vehicle is supported. The system is readily adapted for the magnetic suspensions, air cushion suspension, and for drive by linear induction motors.

I claim:

1. A switching system for guided vehicles, comprising a main guideway having a pair of horizontally spaced main guides, each main guide having a vertically disposed running surface and a horizontally disposed running surface, the vertically disposed surfaces on said main guides facing one another and extending upwardly from and outwardly of respective ones of said horizontally disposed running surfaces, a secondary guideway having a pair of horizontally spaced secondary guides, each secondary guide having a vertically disposed running surface and a horizontally disposed running surface, the vertically disposed surfaces of said secondary guides facing one another and being spaced apart the same distance as said vertically disposed surfaces of said main guides, the horizontally disposed running surfaces of said secondary guides being located outwardly of said vertically disposed running surfaces of said secondary guides, said secondary guides joining said main guides at a switching region, each of said vertically disposed surfaces of said secondary guides and said main guides being one in the same vertically disposed surface prior to the switching region and being co-extensive with each other in said switching region, said secondary guideway diverging vertically from said main guideway with said horizontally disposed surfaces of said secondary guides being at a level which is above said horizontally disposed surfaces of said main guides, a vehicle having main support means for coacting with said horizontally disposed surfaces of said main guides for supporting said vehicle on said main guides, guide means for coacting with said vertically disposed surfaces on each side of said vehicle for providing lateral guidance, and retractable support means on both sides of said vehicle having a retracted and an extended position, said retractable support means in its retracted position being clear of all guides and adapted to be moved to its extended position prior to said vehicle reaching said switching region with said retractable support means being above and clear of said horizontally disposed surfaces of said secondary guides whereby when said vehicle reaches said switching region said retractable support means coacts with the horizontally disposed surfaces of said secondary guides to support said vehicle thereon, the coaction between said guide means and said vertically disposed surfaces being continuous.

2. A switching system for guided vehicles as defined in claim 1 in which said guide means for coacting with said vertically disposed surfaces on each side of said vehicle includes drive means for causing said vehicles to move along a guideway.

3. A switching system for guided vehicles as defined in claim 1 in which said guide means for coacting with said vertically disposed surfaces on each side of said vehicle includes braking means for slowing and stopping said vehicle.

4. A switching system for guided vehicles as defined in claim 1 in which said guide means for coacting with said vertically disposed surfaces on each side of said vehicle includes wheels engaging said vertically disposed surfaces.

5. A switching system as defined in claim 1 in which said main support means and said retractable support means includes wheels for engagement with horizontally disposed surfaces of said main and secondary guides, respectively.

6. A vertical switching arrangement for guided vehicles, comprising a main guideway for said guided vehicles and a secondary guideway for said guided vehicles, the secondary guideway branching upwardly with respect to said main guideways and sloping away from said main guideway to a level above it, said main guideway having a pair of vertically disposed running surfaces horizontally spaced apart by a predetermined distance and facing one another, and a pair of horizontally disposed running surfaces extending inwardly of and below respective ones of said vertically disposed surfaces, said secondary guideway having a pair of vertically disposed running surfaces spaced apart by said predetermined distance and facing one another, and a pair of horizontally disposed running surfaces extending outwardly of and above respective ones of said vertically disposed surfaces, each of said main and secondary guideways joining at a transition region, with respective ones of vertically disposed surfaces of said main and secondary guideways being one in the same surface prior to the transition region and being coextensive at the transition region, a vehicle having main support means for coacting with the horizontally disposed running surfaces of said main guideway, retractable support means having an extended and a retracted position for coacting with the horizontally disposed running surfaces of said secondary guideway in the extended position thereof and remaining clear of the guideways in the retracted position thereof, and guide means for continuously coacting with the respective vertically disposed surfaces of said main guideway when said vehicle is supported on said main guideway and of said secondary guideway when said vehicle is supported on said secondary guideway.

* * * * *